US010068442B2

(12) United States Patent
Chong et al.

(10) Patent No.: US 10,068,442 B2
(45) Date of Patent: Sep. 4, 2018

(54) LIGHT FIXTURE

(71) Applicant: Hubbell Incorporated, Shelton, CT (US)

(72) Inventors: Matthew John Chong, Baulkham Hills (AU); Nouman Bashir Khan, Glenwood (AU)

(73) Assignee: Hubbell Incorporated, Shelton, CT (US)

( * ) Notice: Subject to any disclaimer, the term of this patent is extended or adjusted under 35 U.S.C. 154(b) by 3 days.

(21) Appl. No.: 15/499,125

(22) Filed: Apr. 27, 2017

(65) Prior Publication Data

US 2017/0316660 A1 Nov. 2, 2017

Related U.S. Application Data

(60) Provisional application No. 62/329,377, filed on Apr. 29, 2016.

(51) Int. Cl.

| | |
|---|---|
| ***G08B 3/00*** | (2006.01) |
| ***G08B 7/06*** | (2006.01) |
| ***F21V 3/00*** | (2015.01) |
| ***F21V 5/04*** | (2006.01) |
| ***F21V 7/04*** | (2006.01) |
| ***F21V 21/096*** | (2006.01) |
| ***F21V 23/00*** | (2015.01) |
| ***G08B 5/36*** | (2006.01) |
| ***H05B 33/08*** | (2006.01) |
| *F21Y 113/13* | (2016.01) |
| *F21Y 115/10* | (2016.01) |

(52) U.S. Cl.

CPC ..... *G08B 7/066* (2013.01); *F21V 3/00* (2013.01); *F21V 5/04* (2013.01); *F21V 7/04* (2013.01); *F21V 21/096* (2013.01); *F21V 23/005* (2013.01); *G08B 5/36* (2013.01); *H05B 33/0857* (2013.01); *F21Y 2113/13* (2016.08); *F21Y 2115/10* (2016.08)

(58) Field of Classification Search

None

See application file for complete search history.

(56) References Cited

U.S. PATENT DOCUMENTS 4,801,928 A * 1/1989 Minter ..... A62B 3/00 340/309.4
5,815,068 A * 9/1998 Vadseth ..... A62B 3/00 340/332
5,931,573 A * 8/1999 Knox ..... B60Q 1/2611 340/471
6,025,773 A * 2/2000 Bresnan ..... G08B 6/00 116/205
6,150,943 A * 11/2000 Lehman ..... G08B 7/062 340/332

(Continued)

*Primary Examiner* — Curtis King

(74) *Attorney, Agent, or Firm* — Michael Best & Friedrich, LLP

(57) ABSTRACT

A light fixture includes a housing having a first portion and a second portion. The light fixture further includes a first light emitting element supported within the first portion of the housing, and a second light emitting element supported within the second portion of the housing. The second light emitting element is controlled such that the second light emitting element provides a different color than the first light emitting element.

20 Claims, 4 Drawing Sheets

(56) References Cited

U.S. PATENT DOCUMENTS 6,310,551 B1 * 10/2001 Croft ..... A61G 1/007 116/51
7,800,511 B1 * 9/2010 Hutchison ..... G08B 7/066 340/3.1
8,717,162 B2 * 5/2014 Sundholm ..... A62B 3/00 315/120
8,810,415 B2 * 8/2014 Grundler ..... A62B 3/00 340/330
9,574,717 B2 * 2/2017 Scapa ..... F21V 23/006
2003/0038727 A1 * 2/2003 Tatar ..... F21S 9/022 340/691.1
2004/0075572 A1 * 4/2004 Buschmann ..... G08B 7/062 340/691.1
2005/0073405 A1 * 4/2005 Spoltore ..... G08B 7/062 340/506
2005/0286247 A1 * 12/2005 Peterson ..... F21S 8/032 362/249.01
2006/0038696 A1 * 2/2006 Arcaria ..... G08B 3/10 340/691.3
2007/0069882 A1 * 3/2007 Mahajan ..... E05B 65/104 340/500
2007/0132575 A1 * 6/2007 Ellul ..... G08B 5/38 340/524
2007/0152808 A1 * 7/2007 LaCasse ..... G08B 7/062 340/524
2008/0022414 A1 * 1/2008 Cahn ..... H04L 9/3236 726/28
2009/0027225 A1 * 1/2009 Farley ..... G08B 7/06 340/6.11
2009/0059602 A1 * 3/2009 Santos ..... G08B 5/36 362/351
2009/0309740 A1 * 12/2009 Savage, Jr. ..... G08B 5/36 340/577
2010/0207777 A1 * 8/2010 Woodford ..... G08B 5/38 340/815.45
2010/0309000 A1 * 12/2010 Munthe-Kaas ..... G08B 5/36 340/573.1
2011/0187543 A1 * 8/2011 Russo ..... G08B 17/10 340/628
2012/0038479 A1 * 2/2012 Ten Wolde ..... F21S 8/033 340/540
2012/0238319 A1 * 9/2012 Lake ..... G08B 5/36 455/556.1
2012/0319860 A1 * 12/2012 Savage, Jr. ..... G08B 5/38 340/691.8
2013/0049985 A1 * 2/2013 Eisenson ..... G08G 1/0965 340/902
2013/0194063 A1 * 8/2013 Keller ..... G08B 7/06 340/4.21
2014/0009301 A1 * 1/2014 Robotham ..... G08B 5/38 340/691.1
2014/0055619 A1 * 2/2014 Holland ..... G08B 5/36 348/159
2015/0339913 A1 * 11/2015 Lyman ..... G08B 25/12 340/287
2016/0035201 A1 * 2/2016 Savage, Jr. ..... H04R 1/028 340/815.45
2016/0049053 A1 * 2/2016 Simmons ..... G08B 7/066 340/815.4
2016/0140823 A1 * 5/2016 Park ..... G08B 7/066 340/628
2016/0247369 A1 * 8/2016 Simmons ..... G08B 7/066
2017/0140619 A1 * 5/2017 Russo ..... G08B 7/064

* cited by examiner

LIGHT FIXTURE

RELATED APPLICATION(S)

This application is based on U.S. provisional application Ser. No. 62/329,377, filed Apr. 29, 2016, the disclosure of which is incorporated herein by reference in its entirety and to which priority is claimed.

BACKGROUND

The present application relates to a light fixture, and more specifically to a light fixture with a warning indicator.

SUMMARY

In some environments (e.g., an underground mine), it is necessary to provide continuous illumination in tunnels and shafts for mine workers and other personnel operating in the mine. It is also desirable to identify unsafe conditions and provide warnings to the mine workers and other personnel.

In one aspect, a light fixture includes a housing having a first portion and a second portion. The light fixture further includes a first light emitting element supported within the first portion of the housing, and a second light emitting element supported within the second portion of the housing. The second light emitting element is controlled such that the second light emitting element provides light having a different color than the first light emitting element.

In another aspect, a lighting system includes a plurality of light fixtures. Each of the light fixtures includes a housing, and a light emitting element supported within the housing. The light system further includes a control center in electrical communication with the plurality of light fixtures. The control center is operable to control each of the light fixtures. The control center is operable to independently control the light emitting element of each of the light fixtures. The light emitting element is selectively illuminated a color to act as an indicator.

Other aspects of the application will become apparent by consideration of the detailed description and accompanying drawings.

DETAILED DESCRIPTION

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

Figure 1:
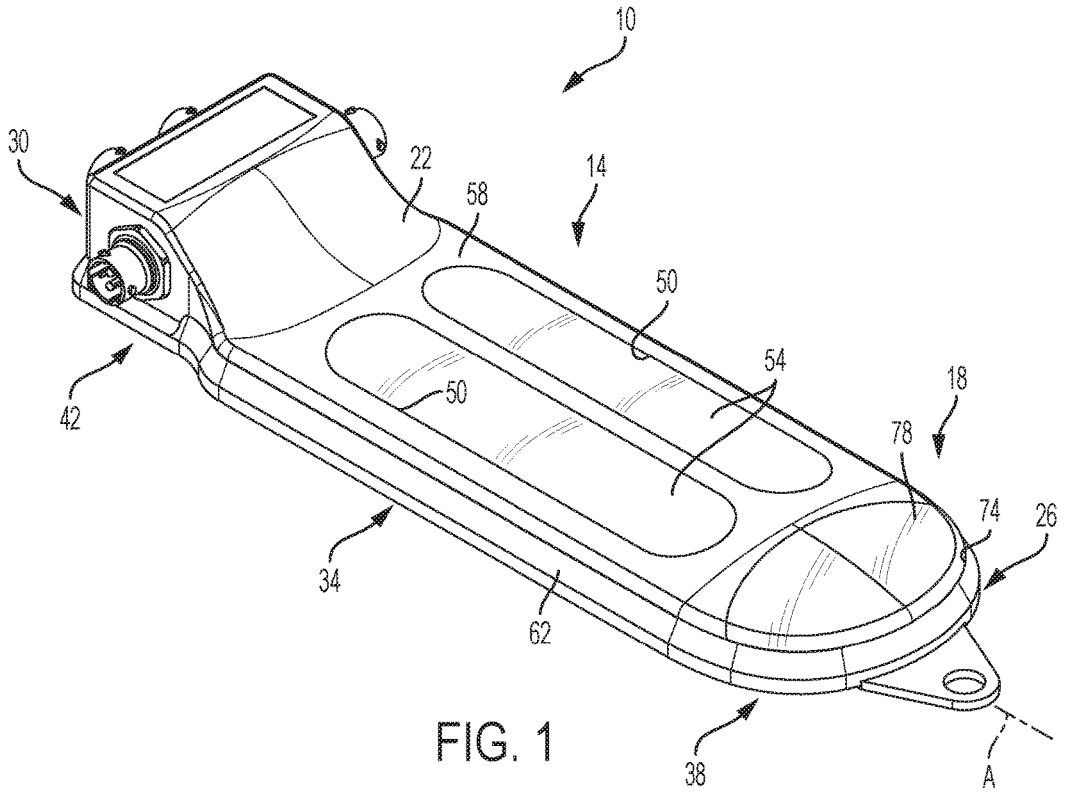
FIG. 1 is a perspective view of a light fixture.

FIG. 1 illustrates a light fixture 10 that includes a primary or illumination light portion 14 for providing illumination of an area around the light fixture 10, and an indicator light portion 18. In some embodiments, the indicator light portion 18 provides information to personnel based on the color of the emitted light. This information may include, among other things, location identification, specific warnings, or other information.

With continued reference to FIG. 1, the light fixture 10 includes an elongated housing 22 that extends along a longitudinal axis A between a first end 26 and a second end 30. The housing 22 includes a first portion 34, a second portion 38, and a third or connector portion 42. In the illustrated embodiment, the second portion 38 is adjacent the first end 26 of the housing 22, the third portion 42 is adjacent the second end 30 of the housing 22, and the first portion 34 generally extends along a portion of the axis A between the second portion 38 and the third portion 42.

Figure 4:
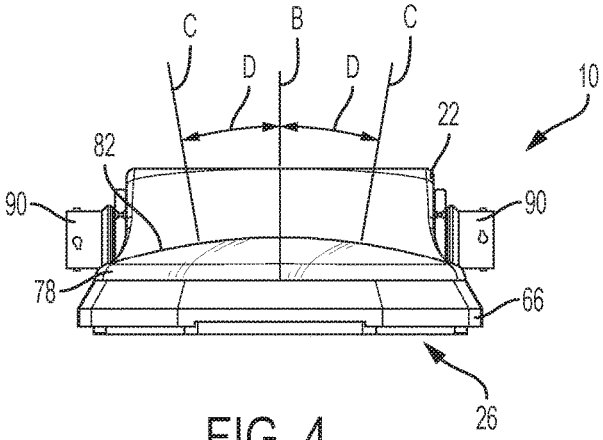
FIG. 4 is a front view of the light fixture of FIG. 1.

The first portion 34 of the housing 22 defines a pair of elongated illumination light openings 50 on opposite sides of the axis A. Each of the openings 50 supports an elongated illumination lens 54. Each of the illumination lenses 54 may be a diffuser lens for softening light passing through the illumination light openings 50. Alternatively, the illumination lenses 54 may be configured to concentrate or direct light as desired. In the illustrated embodiment, a primary wall 58 of the first portion 34 extends along the axis A and tapers transverse to the axis A downward to side walls 62 of the first portion 34. Accordingly, the illumination light openings 50 and corresponding illumination lenses 54 are angled outwardly away from a center plane B (FIG. 4) that divides the housing 22 in half. In particular, as shown in FIG. 4, a center plane C of each of the illumination light openings 50 intersects the center plane B of the housing 22 to define an angle D. In some embodiments, the angle D is between approximately 5 degrees and approximately 30 degrees. In other embodiments, the primary wall 58 of the housing 22 may be substantially flat such that the center plane C of each of the illumination light openings 50 is parallel to and offset from the center plane B of the housing 22.

Figure 2:
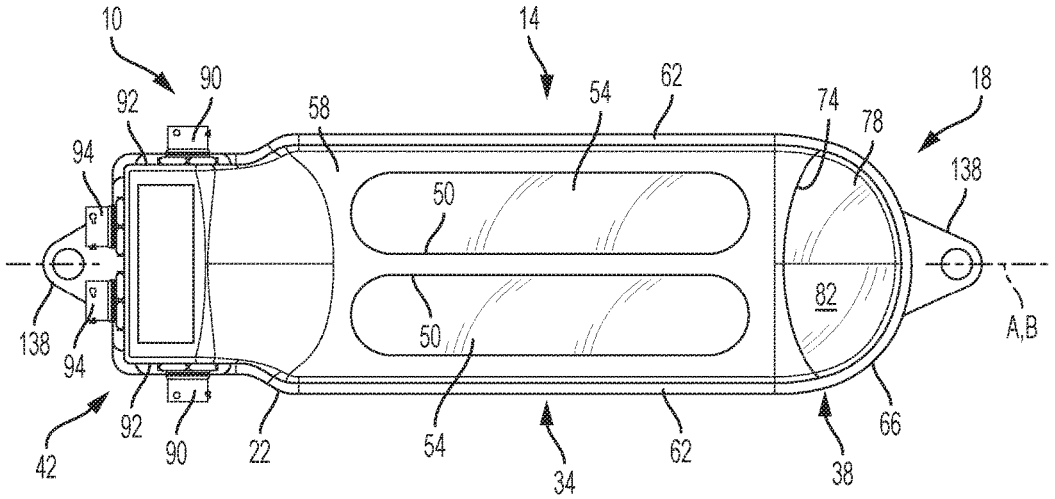
FIG. 2 is a top view of the light fixture of FIG. 1.

Referring to FIGS. 1 and 4, the second portion 38 of the housing 22 has an arcuate wall 66 with a semi-circular shape that passes through the center plane B (FIG. 4) of the housing 22. The arcuate wall 66 extends between and connects the side walls 62, forming an end of the housing 22. The second portion 38 defines a third or indicator light opening 74 that extends between the side walls 62 and the arcuate wall 66 of the housing 22. The indicator light opening 74 supports an indicator lens 78 that has a curved outer surface 82 (FIG. 4). The curved outer surface 82 of the indicator lens 78 generally has a spheroidal shape. The indicator lens 78 extends through an angle of between approximately 135 degrees and approximately 180 degrees in a plane perpendicular to the center plane B (FIG. 4) of the housing 22. In the illustrated embodiment, the center plane B of the housing 22 divides the indicator lens 78 into mirror halves (FIG. 2). Due at least partially to the spheroidal shape of the indicator lens 78, the indicator lens 78 is visible from opposite sides of the light fixture 10 (FIG. 3), from a planar view of the light fixture 10 (FIG. 2), and from a front view of the light fixture 10 (FIG. 4).

Referring to FIG. 2, the light fixture 10 further includes a plurality of electrical connectors 90, 94 positioned at the second end 30 of the housing 22. Each of a first pair of electrical connectors 90 extend from opposite side walls 92 of the third portion 42 of the housing 22 transverse to the axis A. Each of a second pair of electrical connectors 94 extend from an end wall 98 of the third portion 42 of the housing 22 parallel to and on opposite sides of the axis A. In some embodiments, the light fixture 10 only includes one of the first pair of electrical connectors 90 and the second pair of electrical connectors 94. In other embodiments, the light fixture 10 includes both of the first pair of electrical connectors 90 and second pair of electrical connectors 90. The electrical connectors 90, 94 provide electrical communication to the light fixture 10 from a power source.

Figure 3:
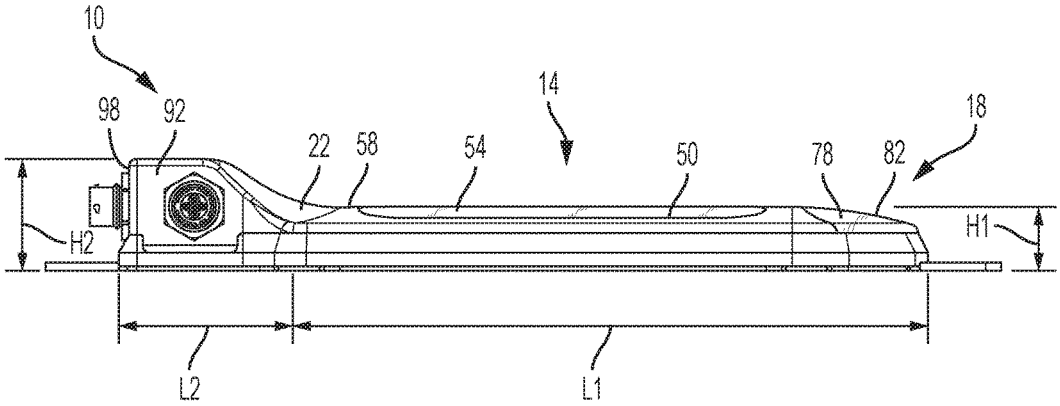
FIG. 3 is a side view of the light fixture of FIG. 1.

Referring to FIG. 3, the first portion 34 of the housing 22 has a first height H1. The second portion 38 has the same height H1. The first portion 34 and the second portion 28 define a combined length L1. The third portion 42 of the housing 22 has a second height H2 and a length L2. In the illustrated embodiment, the first height H1 of the first portion 34 and the second portion 38 of the housing 22 is approximately half of the second height H2 of the third portion 42 of the housing 22, while the length L1 of the first portion 34 and the second portion 38 of the housing 22 is significantly longer than the length L2 of the third portion 42 of the housing 22, providing a substantially low profile for the light fixture 10.

Figure 5:
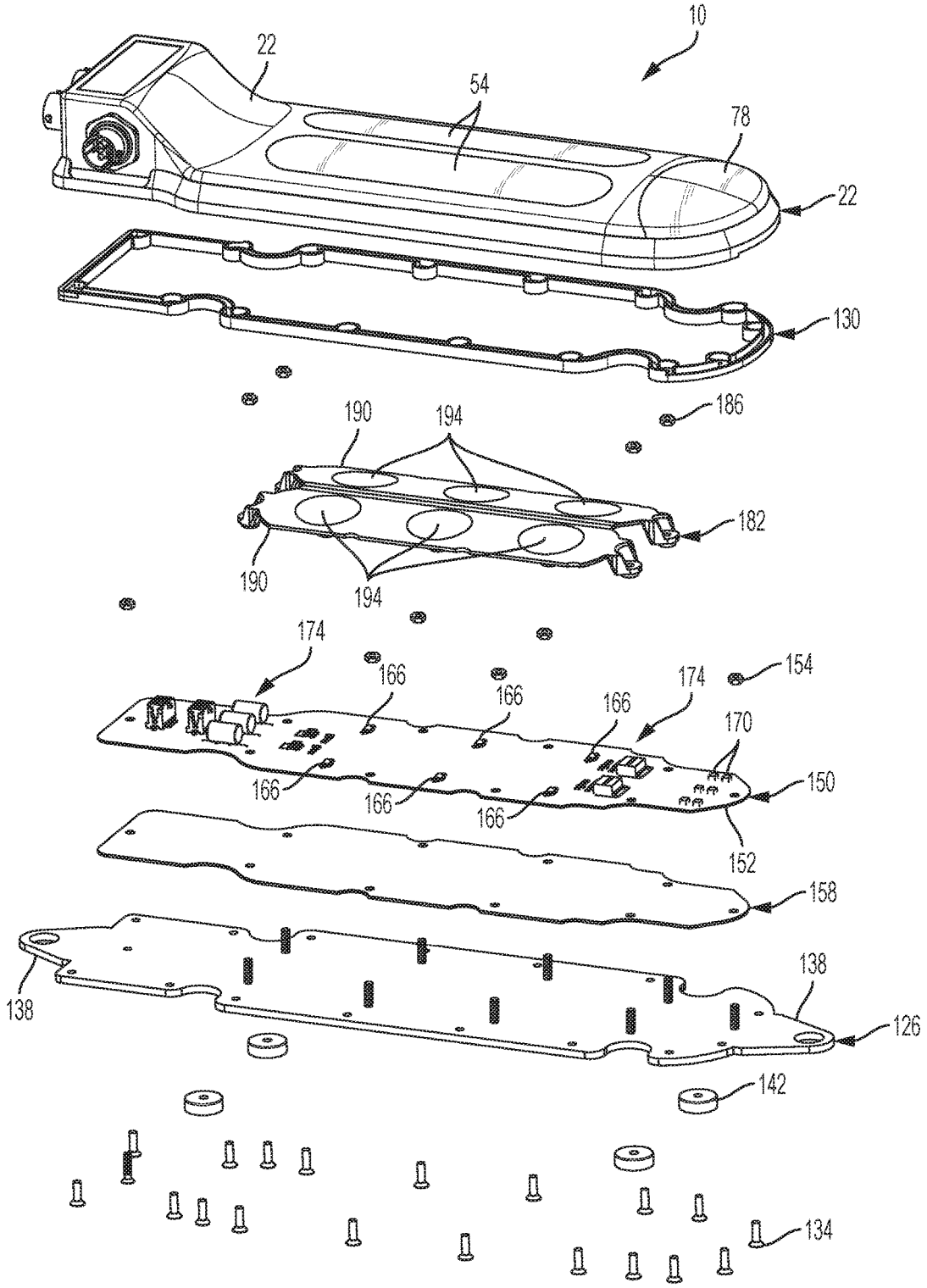
FIG. 5 is an exploded view of the light fixture of FIG. 1.

Referring to FIG. 5, the light fixture 10 further includes a planar mounting plate 126 and a gasket 130. The mounting plate 126 is coupled to the housing 22 to enclose an internal cavity (not shown) defined within the housing 22. The mounting plate 126 is coupled to the housing 22 by a plurality of mounting plate fasteners 134. In alternate embodiments, the mounting plate 126 is coupled to the housing 22 by snap-fit clips, adhesive, or other suitable methods. The gasket 130 extends around a perimeter of the mounting plate 126. The gasket 130 is positioned between the mounting plate 126 and the housing 22 and seals the internal cavity of the housing 22 from external contaminants, such as dust.

The mounting plate 126 includes mounting bosses 138 that are positioned adjacent the first and second ends 26, 30 of the housing 22 when the mounting plate 126 is coupled to the housing 22. Each of the mounting bosses 138 receives fasteners (e.g., bolts—not shown) to mount the light fixture 10 to a structure or mine surface. In the illustrated embodiment, the light fixture 10 further includes magnets 142 that are coupled to the housing 22. The magnets 142 may be used in addition to or as an alternative to the mounting bosses 138 to mount the light fixture 10 to a structure made of or including magnetic material (e.g., iron or steel). The mounting bosses 138 and magnets 142 allow the light fixture 10 to be easily mounted on a ceiling, floor, or wall.

With continued reference to FIG. 5, the light fixture 10 further includes a circuit board 150. In the illustrated embodiment, the circuit board 150 is a printed circuit board (PCB). The circuit board 150 is coupled to the mounting plate 126 by circuit board fasteners 154. In other embodiments, the circuit board 150 is coupled to the mounting plate 126 by snap-fit clips, adhesive, or other suitable methods. In addition, an insulator-thermal pad 158 is positioned between the circuit board 150 and the mounting plate 126. The insulator-thermal pad 158 provides both thermal and electrical insulation between the circuit board 150 and the mounting plate 126 to prevent short circuiting and overheating of the circuit board 150.

The circuit board 150 includes a plurality of first light emitting elements (e.g., light emitting diodes or LEDs) 166 corresponding to the illumination light portion 14. The first light emitting elements 166 emit light out of each of the illumination light openings 50 and through the corresponding illumination lenses 54. In the illustrated embodiment, the first light emitting elements 166 are positioned in two rows of three, and the rows are spaced parallel to one another and on either side of the axis A on the circuit board 150, adjacent each of the illumination openings 50. In some embodiments, the first light emitting elements 166 may include another suitable light source (e.g., incandescent or fluorescent light bulbs).

The circuit board 150 further includes a plurality of second light emitting elements (e.g., LEDs) 170 corresponding to the indicator light portion 18. The second light emitting elements 170 are coupled to the circuit board 150 and emit light out of the indicator light opening 74 and through the indicator lens 78. In the illustrated embodiment, six second light emitting elements 170 are positioned proximate an end 152 of the circuit board 150 corresponding to the first end 26 of the housing 22 so that the second light emitting elements 170 are adjacent to the indicator light opening 74. In addition, the second light emitting elements 170 may be multicolored LEDs that can be controlled to emit various colors depending on a supply voltage. In some embodiments, the first light emitting elements 166 are also multicolored LEDs. In some embodiments, the second light emitting elements 170 may include another suitable light source (e.g., incandescent or fluorescent light bulbs). In some embodiments, the second light emitting elements 166 may emit the same or similar color as the first light emitting elements 170, but the indicator lens 78 may alter the emitted light such that the indicator light portion 18 is colored and/or a different color from the illumination light portion 14.

The circuit board 150 is in communication with the electrical connectors 90, 94 to receive power in order to illuminate the first and second light emitting elements 166, 170. The circuit board 150 further includes controller or driver components 174 that are in electrical communication between the electrical connectors 90, 94 and the first and second light emitting elements 166, 170, such that the electrical connectors 90, 94 may receive signals that are sent to and processed by the driver components 174 to control the first and second light emitting elements 166, 170. For example, the intensity and/or the color of the first and second light emitting elements 166, 170 may be controlled by signals sent to the light fixture 10. In the illustrated embodiment, the signals are sent by a control center 118 (FIG. 6) that is connected to the light fixtures 10 via wiring connected to the light fixtures 10 by the electrical connectors 90, 94.

With continued reference to FIG. 5, the light fixture 10 further includes a reflector 182. The reflector 182 is positioned between the illumination lenses 54 and the first light emitting elements 166 and is coupled to the mounting plate 126 by reflector fasteners 186. In alternate embodiments, the reflector 182 is coupled to the mounting plate 126 by snap-fit clips, adhesive, or other suitable methods.

The reflector 182 includes two reflector halves 190. Each of the reflector halves 190 corresponds to one of the illumination light openings 50. Each of the reflector halves 190 is angled with respect to the center plane B of the housing 22 to be parallel with a corresponding one of the illumination lenses 54. Each of the reflector halves 190 also includes individual reflector elements 194 corresponding to each of the first light emitting elements 166 to concentrate and direct light out the corresponding illumination light opening 50. Since light emitted by the first light emitting elements 166 has a nearly hemispherical light distribution pattern, each of the reflector elements 194 reflects the light to maximize the intensity and efficiency of the light exiting the illumination light openings 50.

In the illustrated embodiment, the first light emitting elements 166 of the illumination light portion 14 and the second light emitting elements 170 of the indicator light portion 18 are independently controllable. The first light emitting elements 166 of the illumination light portion 14 may be controlled to illuminate an area adjacent the illumination light openings 50 (e.g., an area beneath the light fixture 10, if the light fixture 10 is mounted such that the illumination light openings 50 face downwardly). In particular, the driver components 174 provide the first light emitting elements 166 with power so as to emit light. Each of the first light emitting elements 166 emits light in a generally hemispherical distribution. The light from each of the first light emitting elements 166 is reflected and directed by the corresponding reflector elements 194 of the reflector 182. Concentrated light exits each of the reflector elements 194, such that a center beam of light exiting each of the reflector elements 194 generally is directed at an angle to the center plane B of the housing 22 along the center plane C of the corresponding illumination light opening 50. The concentrated light exits the illumination light openings 50 and passes through the illumination lenses 54. The angled illumination light openings 50 project light outwardly away from the center plane C of the housing 22 to provide a wider light distribution, increasing required spacing between adjacent light fixtures 10, and thus decreasing the number of light fixtures 10 required to illuminate the same area of a path. The intensity of the light emitted by the first light emitting elements 166 of the illumination light portion 14 may be controlled. In some embodiments, the first light emitting elements 166 emit white light. In other embodiments, the color of the light emitted by the first light emitting elements 166 may vary from white light, and/or may be adjustable.

The second light emitting elements 170 of the indicator light portion 18 are independently controlled to emit light. Light emitted by the second light emitting elements 170 exits the indicator light opening 74 and passes through the indicator lens 78. The indicator lens 78 diffuses light so that the indicator lens 78 appears to be illuminated as a single light source, emitting light in all directions from the outer surface 82 of the indicator lens 78. A signal is sent from the control center 118 to the driver components 174 through the electrical connectors 90, 94 to illuminate the second light emitting elements 170 in accordance with the signal. The control center 118 may send a different signal to illuminate the second light emitting elements 170 based on various indicator conditions. For example, a signal may be sent to illuminate the second light emitting elements 170 of the indicator light portion 18 to indicate the status of nearby equipment or a location (e.g., a location of moving equipment or a location of an exit point), or to indicate warnings (e.g., unsafe gas concentration levels), which may be readily perceived based on a distinct color emitted by the indicator light portion 18. The second light emitting elements 170 may be illuminated with one or more different colors, each color representing a different condition. Each color may inform personnel (e.g., mine workers) of the corresponding condition. The color of light emitted by the second light emitting elements 170 is preferably a distinct color from that of the light emitted for illumination by the first light emitting elements 166 in order for personnel to understand the meaning of the indicator light portion 18 by viewing the light fixture 10.

In some embodiments, the second light emitting elements 170 may emit red or amber light to indicate unsafe gas levels, and may emit green light to indicate an exit point of a mine tunnel. In addition, the second light emitting elements 170 may be controlled to continuously emit light or to intermittently emit light in an on-and-off type pattern.

In some embodiments, the second light emitting elements 170 of the indicator light portion 18 may be illuminated to inform personnel of the status of equipment. For example, the second light emitting elements 170 may illuminate the indicator light portion 18 in a first color (e.g., green) when adjacent corresponding equipment is operational, and may illuminate the indicator light in a second color (e.g., red or amber) when the equipment is not operational.

In some embodiments, the second light emitting elements 170 of the indicator light portion 18 may be illuminated to indicate measured gas levels in a general proximity of the light fixture 10. The gas concentration levels may be measured by a sensor 122 (FIG. 6) that communicates with the control center 118 and/or directly with the light fixture 10. In some embodiments, the sensor 122 is housed within the light fixture 10. In other embodiments, the sensor 122 is independent of the light fixture 10. When the measured gas concentration levels are above a predetermined level a signal is sent to the light fixture 10 to illuminate the second light emitting elements 170 of the indicator light portion 18 to provide a warning indicator to personnel. In some embodiments, the second light emitting elements 170 may emit red or amber light to inform personnel of unsafe gas levels in the general proximity of the light fixture 10.

Figure 6:
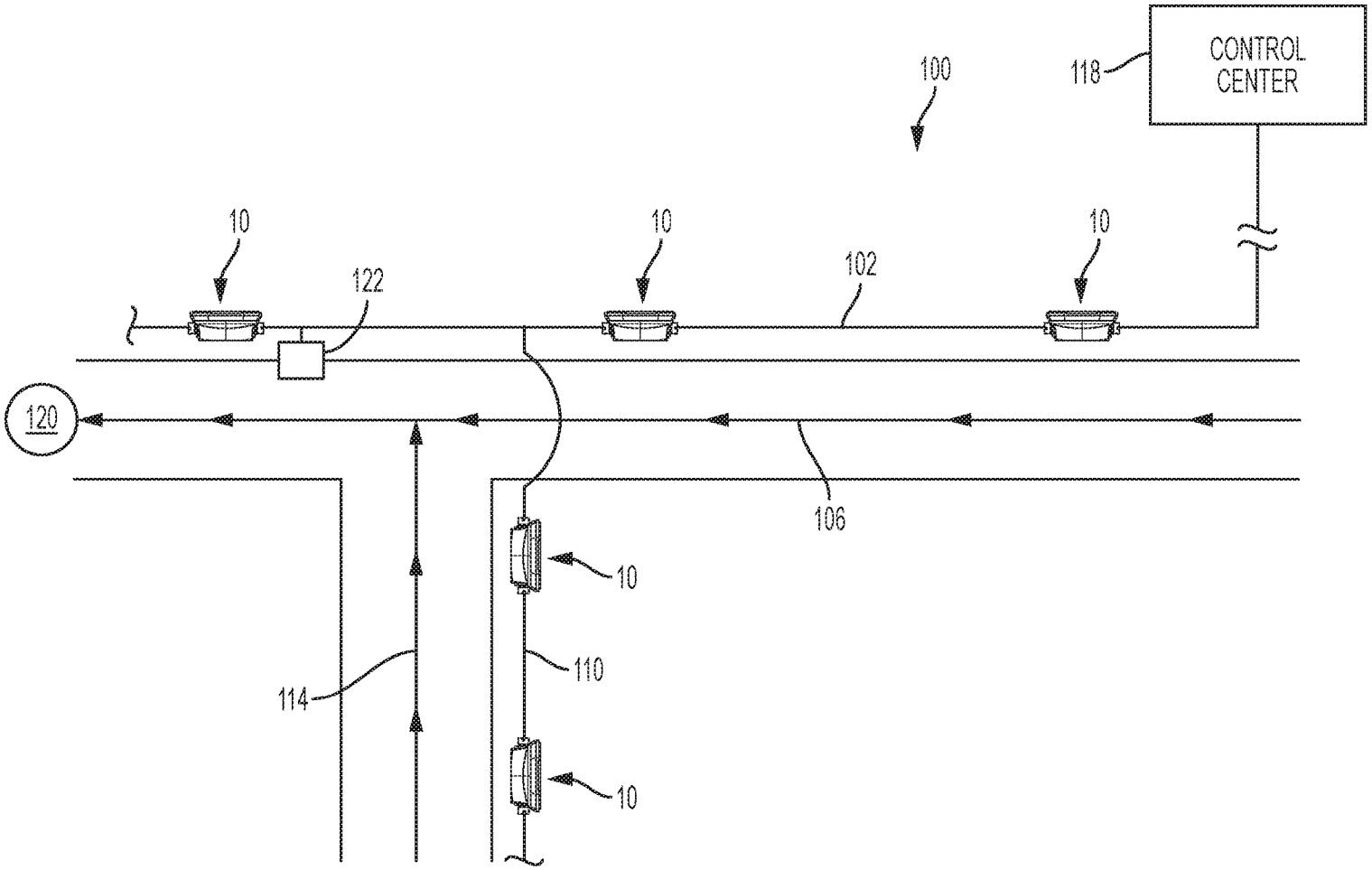
FIG. 6 is a schematic illustrating a plurality of light fixtures connected to a control center and positioned along a path.

Referring to FIG. 6, the electrical connectors 90, 94 allow multiple light fixtures 10 to be connected together in a plurality of strings of light fixtures 10 via wiring to form a lighting system 100, in which each of strings corresponds to a path (e.g., a mine tunnel) and each of the light fixtures 10 in one of the strings is positioned along a corresponding one of the paths. In the illustrated embodiment, the lighting system includes first and second strings 102, 110 of light fixtures 10 that correspond with first and second intersecting paths 106, 114. In addition, the first string 102 is connected to the control center 118 and the second string 110 is connected to the first string 102, such that the first and second strings 102, 110 of the light fixtures 10 are in electrical communication with the control center 118. Although in the illustrated embodiment there are two strings of light fixtures 10 that correspond with two intersecting paths, in other embodiments there may be any number strings of light fixtures 10 corresponding to intersecting and/or parallel paths.

The indicator light portion 18 of each of the light fixtures 10 in the first string 102 may be illuminated along the first path 106 to direct personnel to a specified location 120, such as an exit point or another path. In other embodiments, the indicator light portion 18 of each of the light fixtures 10 in the second string 110 and a portion of the first string 102 may be illuminated along the second path 114 and a portion of the first path 106 to direct personnel to the specified location 120. The indicator light portions 18 of each of the light fixtures 10 in the strings 102, 110 may be illuminated along the paths 106, 114 to also direct rescue crews to a mine collapse, direct service workers to an unsafe condition or to equipment in need of repair. The controlled lighting prevents personnel from getting lost and aids them in arriving at a desired destination quickly and safely, particularly when there are multiple interconnected and diverging paths. In still other embodiments, the indicator light portion 18 of a single light fixture 10 adjacent the location 120 (i.e., exit point, equipment, or mine collapse), may be illuminated to indicate the location 120 to personnel. In still other embodiments, the indicator light portion 18 of the light fixtures 10 may provide a localized warning (e.g., unsafe gas concentration levels) by illuminating some of the indicator light portions 18 of each of the light fixtures in the strings 106, 114 in the vicinity of the unsafe condition. In the illustrated embodiment, gas concentration levels are measured by a sensor 122 that is electrically connected to the first string 102 of light fixtures 10 and positioned adjacent one of the light fixtures 10. The sensor 122 may be configured to communicate with the control center 114 or directly with the corresponding light fixture 10. In some embodiments, a sensor may be positioned adjacent each of the light fixtures 10.

The light fixtures 10 are spaced apart along the first and second paths 106, 114 by such a distance that each of the illumination light portions 14 illuminates an area of one of the paths 106, 114 to provide generally continuous illumination along the first and second paths 106, 114. In addition, due to the shape of the indicator light window 74 and the indicator lens 78 and being located on the first end 26 of the housing 22, the indicator lens 78 may be viewed from either side of the light fixture 10. Accordingly, light emitted by the second light emitting elements 170 of the indicator light portion 18 may be seen when following the paths 106, 114 from either direction.

In general, the light fixture includes a primary light and an indicator light. The primary light provides illumination over an area. The indicator light may be controlled independently from the primary light and be illuminated to indicate a path, a location, or a safety warning.

Although aspects have been described in detail with reference to certain preferred embodiments, variations and modifications exist within the scope and spirit of one or more independent aspects as described. Various features and advantages are set forth in the following claims.

What is claimed is:

1. A light fixture, comprising:

a housing having a first portion and a second portion;

a first light emitting element supported within the first portion of the housing configured to illuminate an area during a normal operation;

a second light emitting element supported within the second portion of the housing; and an indicator lens positioned in the second portion of the housing, wherein the indicator lens includes a spheroidal shaped portion and the second light emitting element is controlled such that the second light emitting element provides light having a different color than the first light emitting element through the indicator lens to indicate a non-normal operating condition.

2. The light fixture of claim 1, further comprising at least one driving component in electrical communication with the first light emitting element and the second light emitting element, wherein when the at least one driving component receives a first signal, the second light output of the second light emitting element is a first color to indicate a first condition, wherein when the at least one driving component receives a second signal, the second light output of the second light emitting element is a second color indicating a second condition, and wherein the first and second colors are substantially different.

3. The light fixture of claim 1, wherein the housing has first and second ends, wherein the first portion of the housing extends between the first and second ends, wherein the first portion defines an opening, and wherein the first light emitting element is configured to direct a first light output through the opening.

4. The light fixture of claim 3, wherein the opening is defined at an oblique angle relative to a plane extending between the first and second ends of the housing and dividing the housing in half.

5. The light fixture of claim 1, wherein the housing has an end, wherein the second portion of the housing is adjacent the end of the housing, wherein the second portion defines an opening, and wherein the indicator lens is positioned in the opening.

6. The light fixture of claim 5, wherein the opening is partially defined by an arcuate wall of the housing and wherein the indicator lens extends between opposite side walls of the housing.

7. The light fixture of claim 6, wherein the curved outer surface of the indicator lens extends through an angle of between approximately 135 degrees and approximately 180 degrees.

8. The light fixture of claim 1, further comprising at least one circuit board supported within the housing, and at least one driving component coupled to the at least one circuit board, wherein the first light emitting element includes a first light emitting diode (LED) coupled to the at least one circuit board, and wherein the second light emitting element includes a second LED coupled to the at least one circuit board.

9. The light fixture of claim 8, wherein the second LED is a multi-colored LED controllable by the at least one driving component to change a color of light outputted from the second LED in accordance with a signal received by the at least one driving component.

10. The light fixture of claim 1, further comprising an electrical connector that is electrically connected with a control center to provide power and electrical communication to the first and second light emitting elements.

11. The light fixture of claim 1, further comprising a mounting boss to mount the safety light to a structure.

12. The light fixture of claim 1, further comprising a magnet coupled to the housing to selectively mount the safety light to a magnetic structure.

13. A lighting system, comprising:

a plurality of light fixtures, each of the light fixtures including a housing having a first portion and a second portion, a primary light emitting element supported within the first portion of the housing and configured to illuminate an area during a normal operation, and an indicator light emitting element supporting within the second portion of the housing and configured to emit a signal light, an indicator lens positioned in the second portion of the housing;

wherein the indicator lens includes a spheroidal shaped portion; and a control center in electrical communication with the plurality of light fixtures, the control center configured to control each of the light fixtures, wherein the control center is further configured to independently control the indicator light emitting element of each of the light fixtures to selectively illuminate the indicator light to act as a colored indicator to indicate a non-normal operating condition.

14. The lighting system of claim 13, wherein each of the light fixtures further includes at least one driving component in electrical communication with the primary light emitting element and the control center, wherein the at least one driving component is operable to receive a signal from the control center, and wherein the primary light emitting element is controlled based on the signal.

15. The lighting system of claim 13, wherein the control center is operable to control the indicator light emitting element, and wherein the plurality of light fixtures are arranged along a path such that the second light emitting element of the light fixtures illuminate the path.

16. The lighting system of claim 13, wherein the plurality of light fixtures are arranged along a path, wherein a location is positioned along the path, wherein one of the light fixtures is positioned adjacent the location, and wherein the indicator light emitting element of the one of the light fixtures is illuminated to indicate the location.

17. The lighting system of claim 16, wherein the indicator light emitting element is illuminated a color different from the primary light emitting element to indicate the location.

18. The lighting system of claim 13, wherein the plurality of light fixtures are arranged along a path, wherein a location is located on the path, and wherein the indicator light emitting element of the light fixtures on the path are illuminated to indicate the path on which the location lies.

19. The lighting system of claim 13, wherein one of the light fixtures is positioned adjacent equipment, and wherein the indicator light emitting element of the one of the light fixtures is illuminated a first color to indicate a first status of the equipment and a second color to indicate a second status of the equipment.

20. The lighting system of claim 13, wherein the non-normal operating condition includes a gas concentration level is greater than a predetermined threshold, the indicator light emitting element of at least one of the light fixtures is illuminated.

* * * * *